United States Patent [19]

Hara

[11] Patent Number: 4,984,313

[45] Date of Patent: Jan. 15, 1991

[54] HEAD-HELD BUBBLE BATH APPARATUS

[75] Inventor: Zenzaburo Hara, Tokyo, Japan

[73] Assignee: Hara Health Industrial Co., Ltd., Tokyo, Japan

[21] Appl. No.: 394,559

[22] Filed: Aug. 16, 1989

[51] Int. Cl.[5] ..... A61H 33/02

[52] U.S. Cl. ..... 4/542; 4/544; 4/568

[58] Field of Search ..... 4/542, 544, 568, 559, 4/567, 569, 570; 128/66; 248/206.3

[56] References Cited

U.S. PATENT DOCUMENTS

| | | | |
|---|---|---|---|
| 2,799,866 | 7/1957 | Jawett | 128/66 X |
| 2,825,069 | 3/1958 | Jorgensen et al. | 4/575 |
| 2,890,852 | 6/1959 | Bradley | 248/206.3 |
| 3,286,712 | 11/1966 | Roden | 128/66 |
| 3,325,829 | 6/1967 | Hotz | 4/544 |
| 3,336,921 | 8/1967 | Lloyd | 128/66 |
| 3,396,722 | 8/1968 | Lindberg, Jr. | 128/66 |
| 3,523,525 | 8/1970 | Vanegas et al. | 128/66 |
| 3,541,616 | 11/1970 | Stricker | 128/66 X |
| 3,802,422 | 4/1974 | Hurst | 128/66 |
| 4,493,393 | 1/1985 | Serber | 108/44 X |
| 4,924,535 | 5/1990 | Yamasaki | 4/568 X |

*Primary Examiner*—Henry J. Recla
*Assistant Examiner*—Robert M. Fetsuga
*Attorney, Agent, or Firm*—Oblon, Spivak, McClelland, Maier & Neustadt

[57] ABSTRACT

A bubble-bath apparatus producing a directable jet of bubble-charged water; the apparatus which may be hand-held or may be mounted on a wall of a bath tub, the apparatus comprising handles to facilitate handling by bathers; adjustable suction cups to allow mounting on nonplanar surfaces; an extendible air intake to allow the apparatus to function at various depths; an air intake head to reduce the level of noise emitted through the air intake; a water intake plate formed so as to produce a slight reduction in water pressure immediately below the apparatus, thereby increasing the stability of the apparatus when placed on the bottom of the bath tub; a motor to drive a water pump; a water pump; a mixing chamber to mix the air and water drawn in; and an adjustable jet nozzle to allow the discharged water to be directed in a desired direction.

4 Claims, 11 Drawing Sheets

HEAD-HELD BUBBLE BATH APPARATUS

BACKGROUND OF THE INVENTION

1. Field of the Invention

The present invention relates to a bubble-generating apparatus producing a jet of water mixed with air bubbles for bathing.

2. Discussion of the Background

Various bathing methods are known for the purpose of promoting good health. One of these methods is the use of a jet of water mixed with numerous fine air bubbles directed into usually hot bath water. The air bubbles mixed in the jet of water can produce effects similar to those of ultrasonic waves of between 20 to 40 KHz, and so can produce a number of healthful effects such as warm massage and cleansing.

The structure of conventional apparatuses generally consists of a housing containing an air intake, a water intake, a water pump driven by a motor, a mixing chamber to produce bubble-charged water, and a jet port out of which the bubble-charged water is discharged. The conventional apparatuses usually draw water from the bath via the water intake by means of the motor-driven pump, draw air in through the air intake, mix the air and water to produce bubble-charged water, and discharge the bubble-charged water back into the bath.

Such conventional apparatuses, however, are generally fixedly installed, with the main housing either outside or inside the bath tub. Also, the mountings of the conventional apparatus are not well accommodated to irregular mounting surfaces. Considerable installation work is required which is costly and time-consuming. In addition, it is generally difficult to remove and reinstall the apparatus when so desired, and it is not possible to hold the apparatus by hand while bathing, thereby limiting the ease of directing the bubble-charged jet.

Conventional bubble-bath apparatuses also generally have air intakes at fixed levels so that the level of bath water may be restricted to certain ranges, or the top of the air intake may protrude far above the rim of the bath tub when this is not desirable. Conventional apparatuses have nozzles which do not allow for the adjustment of the discharge volume and direction. Other problems include excessive noise production during operation, and the lack of handles for easy and secure gripping of the conventional apparatuses, thereby preventing easy maneuvering by a bather. The conventional apparatus also lacks stability because the water intakes are so positioned that no slight suction effect is produced between the bottom of the bath tub and the apparatus by the intake of water.

SUMMARY OF THE INVENTION

The present invention seeks to solve the above problems and to provide a bubble-bath apparatus, requiring no installation work, and which will accommodate a number of mounting surface shapes. The apparatus of the present invention will also function at a variety of water depths, have adjustable jet nozzles, will be easily held by hand at the desired depth while bathing, and will produce a low level of noise.

The invention is a bubble-bath apparatus which produces a bubble-charged jet of water for bathing comprising: a motor; a pump; a water intake connected to the pump; an adjustable air intake; an adjustable discharge nozzle; a mixing chamber connected to the discharge of the pump, the air intake, and the discharge nozzle; adjustable mountings; noise-reduction structures; handles and an overall shape for easy handling. The apparatus may be mounted on the inner wall of the bath tub or the apparatus may be hand-held.

These objects and other object, features, aspects, and advantages of the present invention will become apparent from the following detailed description and drawings of the present invention. However, the preferred embodiments of the present invention are only for the purpose of illustration; various changes andd modifications may be made by those skilled in the art while remaining within the spirit and scope of the invention. Therefore, the present invention is limited only by the scope of the claims.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present invention will now be explained with reference to the above noted figures.

Figure 2:
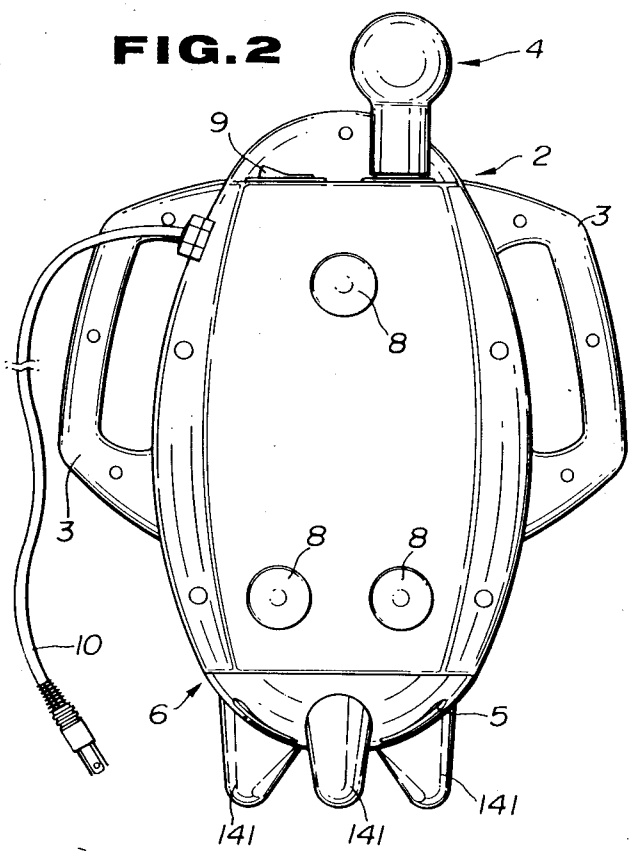
FIG. 2 is a rear view of an apparatus according to the present invention.
Figure 1:
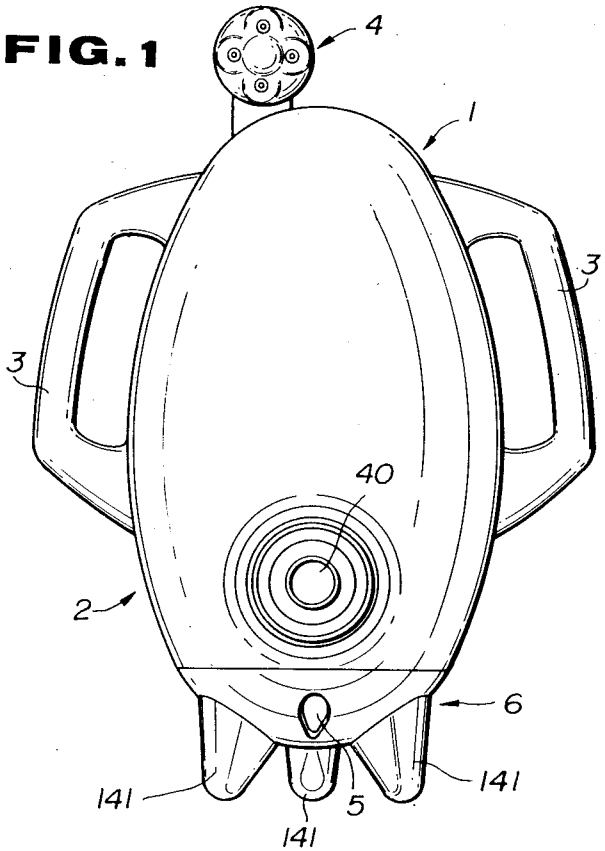
FIG. 1 is a front view of an apparatus according to the present invention.

FIG. 1 shows a bubble-bath apparatus 1 according to the present invention, and more specifically showing: a housing 2; handles 3; air intake 4; jet nozzle 40; and water intake cover plate 6 having triangular water intake port 5. FIG. 2 is a rear view of the embodiment of the bubble-bath apparatus 1 showing: housing 2; handles 3; air intake 4; a generally triangular water intake port 5; water intake cover plate 6; screws; suction cups 8; on/off switch 9; and power supply cord 10.

Figure 3:
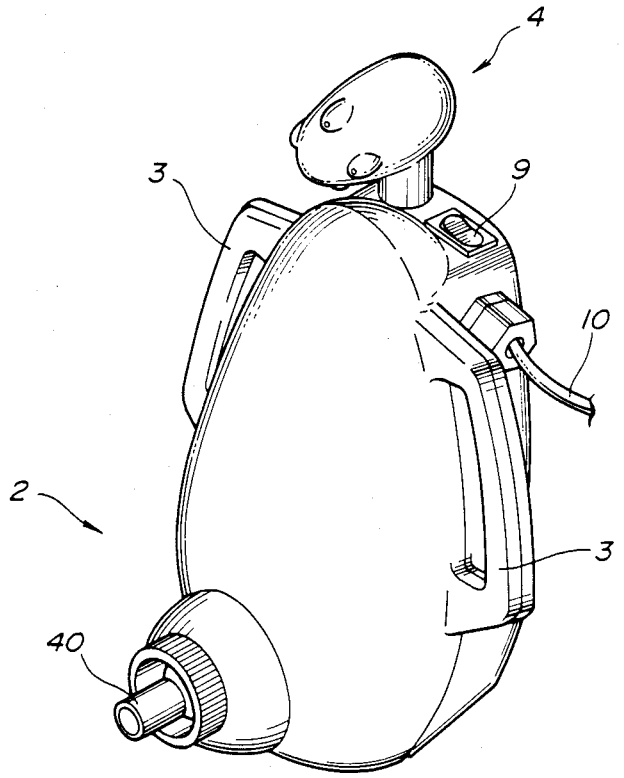
FIG. 3 is an elevated perspective view of an embodiment of the present invention.
Figure 4:
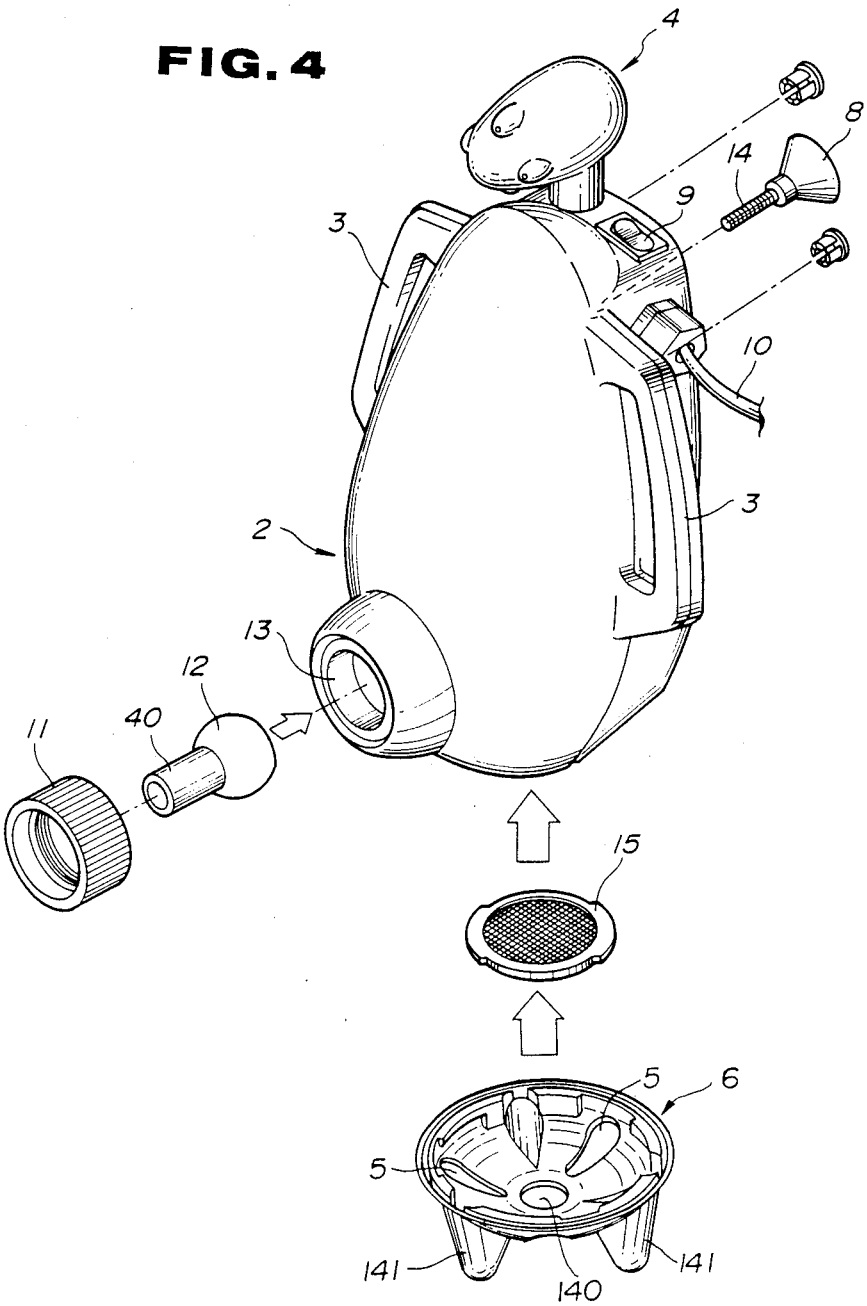
FIG. 4 is an exploded elevated perspective view showing the directable jet nozzle and a portion of the adjustable suction cups.

FIG. 3 is a perspective view of the invention which shows the jet nozzle 40 and the air intake 4. FIG. 4 shows: an exploded view of the jet nozzle 40 comprising locking ring 11, jet nozzle 40, jet nozzle ball 12, and jet nozzle socket 13; a partial exploded view of the adjustable suction cups 8 attached to threaded suction cup shaft 14; and an exploded view of the water intake comprising filter 15 and water intake cover plate 6. The internal surface of the jet nozzle socket 13 is a spherically curved surface a radius of curvature generally equal to that of the jet nozzle ball 12 so that the jet nozzle ball 12 fits in the socket 13 for rotational movement. The jet nozzle ball 12 is integrally formed with the jet nozzle 40, and communicatively interconnects the jet nozzle 40 with the outlet of the water pump 122. The locking ring 11 fits around the jet nozzle ball 12, and is threadedly engaged at its internal thread with an external thread of the socket 13 (see FIG. 9). The inner diameter of the locking ring 11 is substantially smaller than the maximum diameter of the jet nozzle ball 12. Consequently, by screwing or turning action of the locking ring 11, the jet nozzle ball 12 is pressed against the internal wall of the socket 13 and therefore the nozzle 40 is locked in a certain position, otherwise the jet nozzle ball 12 is freed from the restraint of the locking ring 11 and therefore the nozzle 40 becomes pivotable about the center of the jet nozzle ball 12.

Figure 5:
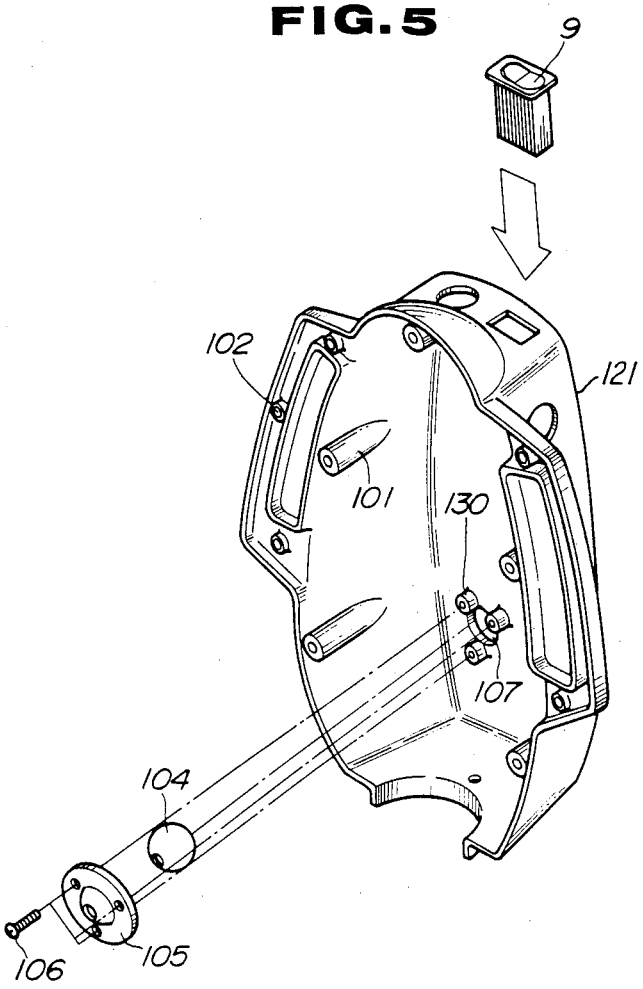
FIG. 5 is an elevated perspective view showing the interior of the rear housing shell and exploded views of the on/off switch and the interior portion of the adjustable suction cups.
Figures 6, 7:
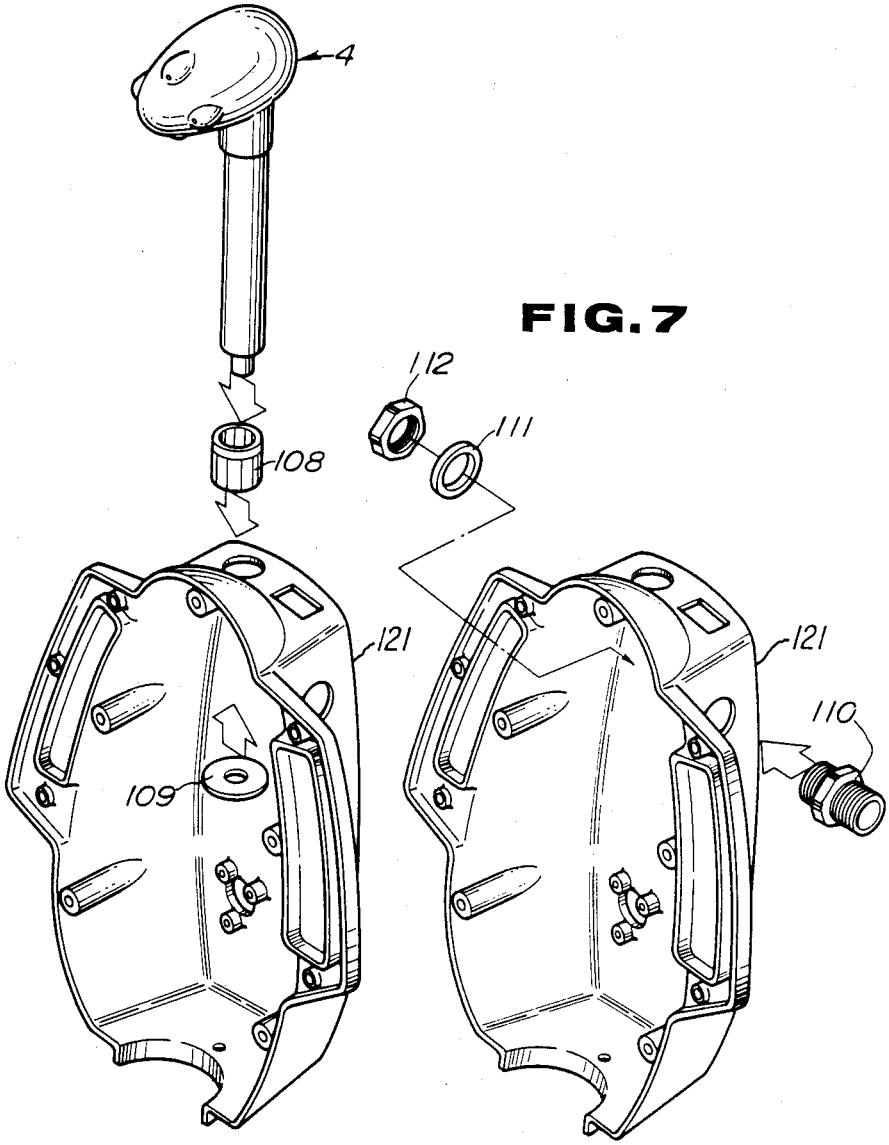
FIG. 6 is an elevated perspective view showing the interior of the rear housing shell and an exploded view of the extendible air intake.
FIG. 7 is an elevated perspective view showing the interior of the housing and an exploded view of the power supply cord securing assembly.

FIG. 5 shows the rear housing shell 121 having peripheral threaded bosses 102, main threaded bosses 101, adjustable-suction-cup bosses 130, ball socket 107, ball 104, ball cover plate 105, screw 106, and on/off switch 9. FIG. 6 again shows the rear housing shell 121 with washer 109, air intake 4, and air intake pipe cuff 108. FIG. 7 shows the rear housing shell 121. The threaded tube 110 passes through the rear housing shell 121, and the tube 110 is threadedly engaged to washer 111 and nut 112 in order to secure powder supply cord 10.

Figure 8:
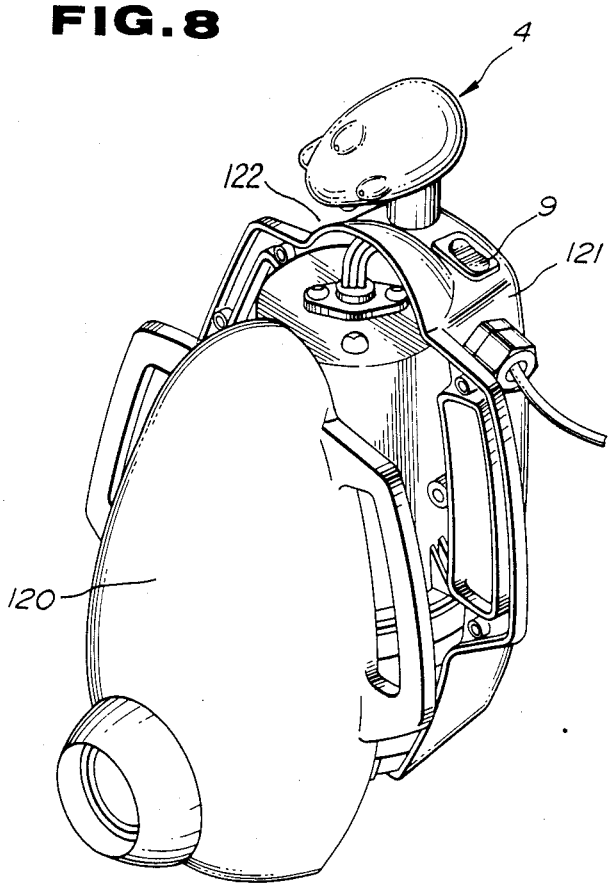
FIG. 8 is an elevated perspective view showing the front housing shell partially removed from the apparatus.
Figure 10:
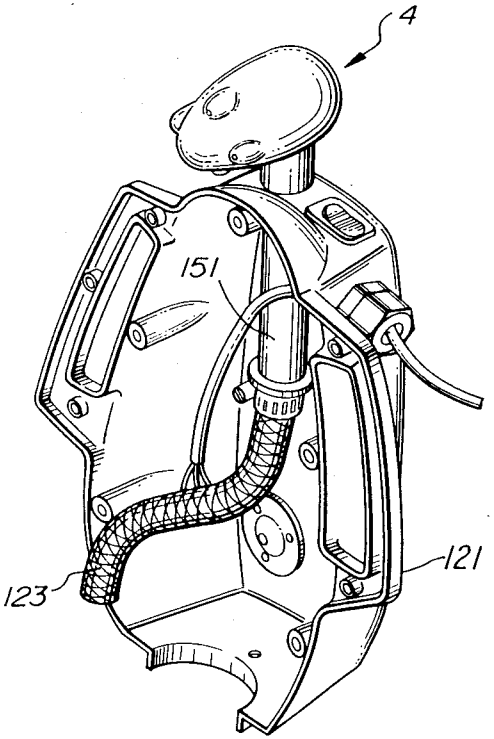
FIG. 10 is an elevated perspective view showing the interior of the rear housing shell and the air hose connected to the air intake pipe.
Figure 9:
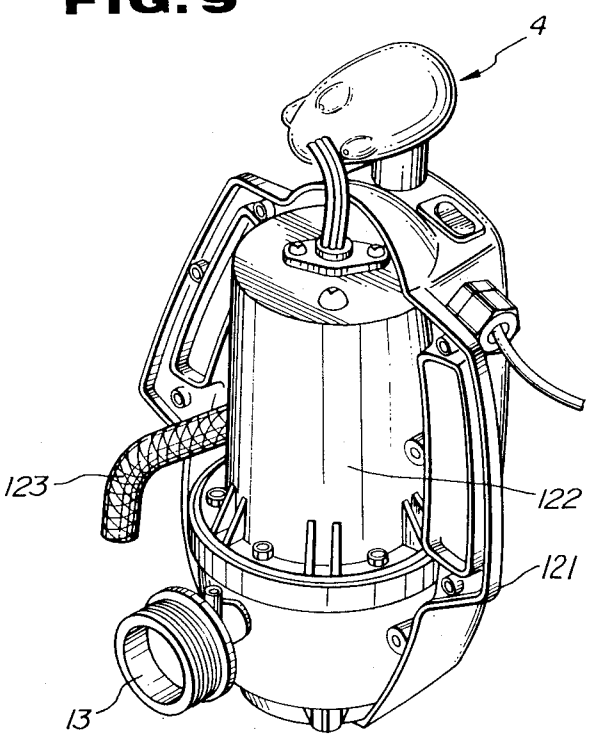
FIG. 9 is an elevated perspective view showing the water pump contained within the rear housing shell.

FIG. 8 shows the front housing shell 120 partially removed, exposing water pump 122 disposed in the rear housing 121, having air intake 4, and on/off switch 9. FIG. 9 has front shell 120 completely removed revealing the water pump 122 connected to socket 13, and air hose 123 is also disposed within the housing 2. FIG. 10 shows the rear housing shell 121 with water pump 122 removed revealing aire hose 123 connected to air intake pipe 151.

Figure 12:
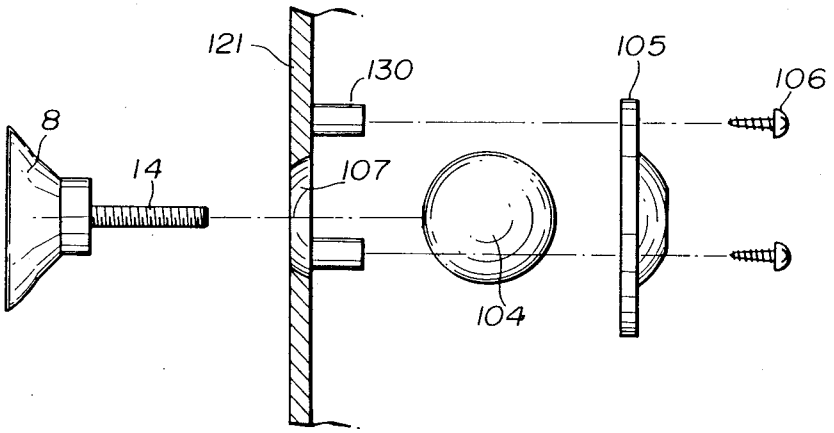
FIG. 12 is an exploded side view of the adjustable suction cup.
Figure 11:
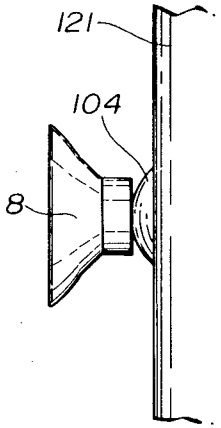
FIG. 11 is a side view of the adjustable suction cup.

FIG. 11 shows a side view of adjustable suction cup 8 mounted via thread suction cup shaft 14 to ball 104 held in rear housing shell 121. FIG. 12 is an exploded view of adjustable suction cup 8 mounted on threaded suction cup shaft 14. This threaded suction cup shaft passes through rear housing shell 121 into ball socket 107. Ball 104 rotatably fits into this ball socket 107 so that its central throughhole engages the threaded suction cup shaft 14. Cover plate 105 is held by screws 106 passing into cover plate bosses 130.

Figure 14:
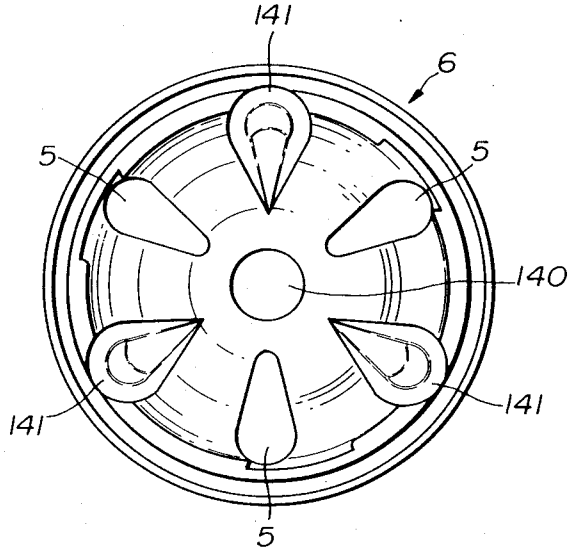
FIG. 14 is a bottom view of the water intake plate.
Figure 13:
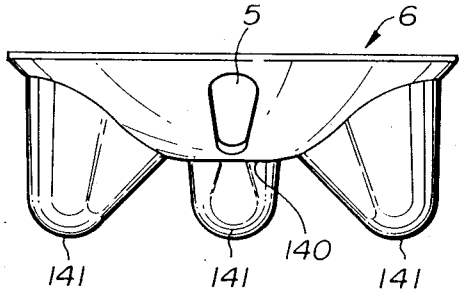
FIG. 13 is a side view of the water intake plate.

FIG. 13 shows a side view of the water intake plate 6 with legs 141 disposed at angles of 120 degrees to one another. FIG. 14 shows the same water intake plate 6 as seen in FIG. 13, but seen in a full bottom view. Triangular water intakes 5 are disposed at 120 degree intervals around the center of the water intake plate 6. At the center of water intake plate 6 is circular water intake 140. Legs 141 are also disposed at 120 degree intervals around the center of water intake plate 6, but the arrangement is rotated 60 degrees with respect to the triangular water intakes 5 so that legs 141 and triangular water intakes 5 are alternately disposed at 60 degree intervals around the center of water intake plate 6.

Figure 16:
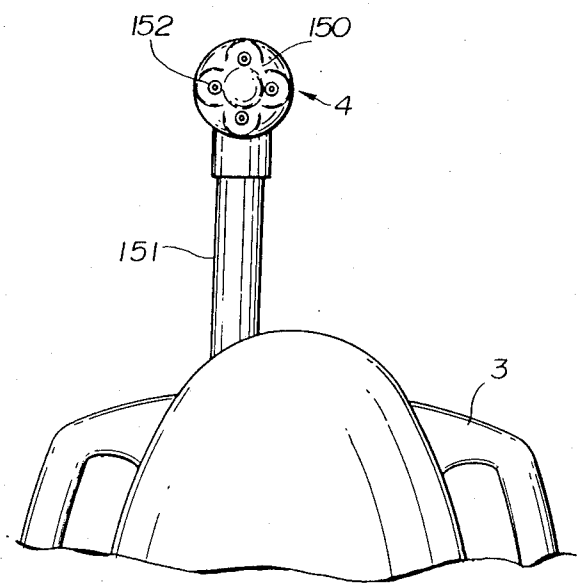
FIG. 16 is a front view of the extendible air intake in the extended position.
Figure 15:
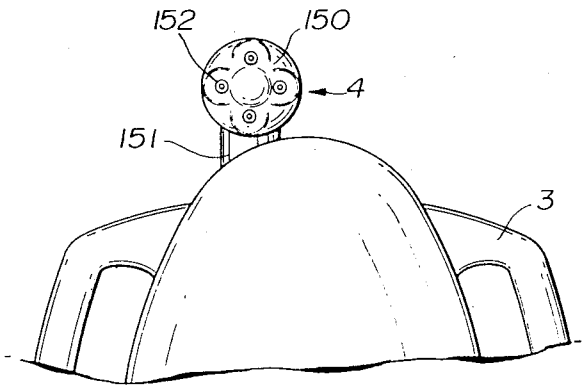
FIG. 15 is a front view of the extendible air intake in the retracted position.

FIGS. 15 and 16 show the extendible air intake 4 having air intake head 150, air intake pipe 151, and air intake ports 152 disposed in air intake head 150. In FIG. 15, the extendible air intake is in a retracted position, while in FIG. 16 it is in an extended position.

Figure 18:
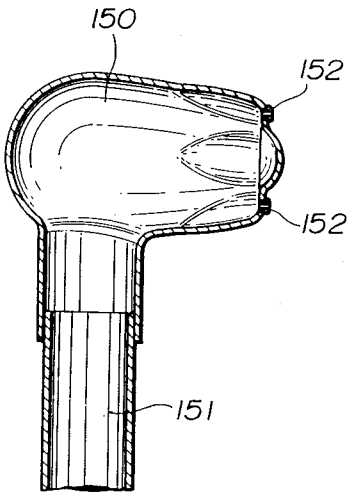
FIG. 18 is a side cross sectional view of the air intake.
Figure 17:
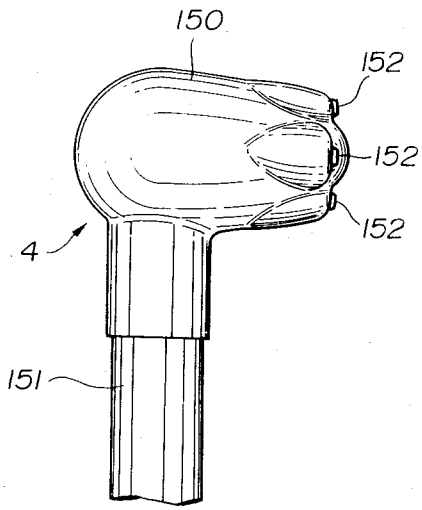
FIG. 17 is a side view of the air intake.

The extendible air intake 4 is shown in a side view in FIG. 17, and in a cross sectional side view in FIG. 18.

The operation of the above embodiment will now be explained with reference to the drawings.

The preferred embodiment of the present invention shown in FIGS. 1 and 2 is of compact design so that it occupies a relatively small volume of a bath, and this compact design also allows the apparatus to be manipulated relatively easily by a bather. The preferred embodiment is provided with handles which provide a secure and easy grip of the apparatus when placing in or removing from a bath, when mounting or disengaging the apparatus from the wall, and especially when a bather holds the unit for use while bathing. The apparatus has generally curved surfaces and edges for comfort and safety.

The apparatus may therefore be easily placed in a bath, and if it is set to stand on the bottom of the bath tub, the legs 141 provide support to allow the apparatus to remain in an upright position. The apparatus may remain in this position so that the bather may use the apparatus by hand, or it may be mounted on the wall of the bath tub using the adjustable suction cups 8. The adjustable suction cups 8 allow the apparatus to be mounted on a flat surface in a bath tub, as well as on surfaces which are not flat. For example, it is possible to mount the apparatus securely on a curved surface since the suction cups 8 may each point in an independent direction. FIGS. 11 and 12 show the exterior assembled adjustable suction cup unit and an exploded view of the entire unit, respectively. Suction cup 8 is unitarily formed with threaded suction cup shaft 14. This shaft passes through rear housing shell 121 into ball 104. Ball 104 is held in ball socket 107 by screws inserted through cover plate 105, allowing ball 104 to rotate, and thereby allowing the suction cup 8 to be directed in the direction appropriate to the mounting surface.

The air intake 4 is made of flexible material and is extendible so that the unit may be placed at a variety of water depths with the air intake head 150 and the air intakes ports 152 remaining above the level of the water. Air entering the air intake ports 152 passes through air intake pipe 151 and air hose 123. Noise generated by the apparatus is greatly reduced by the form of the air intake head 150. The four small air intake ports 152 allow air to enter the air intake system, and since the air intake head 150 is of generally closed construction, noise passing from the interior of the apparatus through the air intake 4 is generally contained within the head. In addition, the atmospheric pressure within the head is lower than the ambient pressure due to the restricted inflow from the air intake ports 152, and reduced pressure also contributes to the reduction in transmission of noise from the interior mechanism through the air intake 4. The operation of the device is therefore significantly quieter than if the air intake 4 simply opened to the outside.

Water is drawn into the unit through water intakes 5 and 140 as shown in FIG. 14, then through filter 15, by means of pump 122 of conventional manufacture. Water intake cover plate 6 is formed so that the unit will stand on the three legs 141, thereby preventing the inflow of water from being obstructed, while the three triangular water intakes 5 and the central circular water intake 140 allow water to flow in freely while preventing the inflow large objects which might clog the filter. The constant inflow of water through the water intakes 5 and 140 produces a slight reduction in water pressure at the base of the apparatus, and this tends to hold the apparatus stationary when the apparatus is placed on the floor of the bath tub.

The water and the air drawn in are then mixed in a mixing chamber and expelled through jet nozzle 40. The direction of the jet nozzle 40 may be adjusted to direct the jet of bubble-charged water in the direction desired by the bather by first, as seen in FIGS. 3 and 4, turning locking ring 11 to free jet nozzle 40, directing the jet nozzle 40 in the desired direction, and then turning the locking ring 11 to lock the jet nozzle 40 in the desired direction.

Obviously, numerous modifications and variations of the present invention are possible in light of the above teachings. It is therefore to be understood that within the scope of the appended claims, the invention may be practiced otherwise than as specifically described herein.

What is claimed is:

1. A hand held bubble bath apparatus for generating a pressurized stream of water mixed with bubbles to be used while bathing, which comprises:

(a) a housing;

(b) water intake means at one end of said housing leading to a motor driven water pump disposed within said housing;

(c) leg means disposed in close proximity to said water intake means, so that said water intake means is prevented from coming into direct contact with an external surface and by which means the apparatus may be stood on end on a horizontal surface, said standing on end being stabilized by a negative pressure generated in proximity to said water intake means by virtue of said water pump within said housing;

(d) air intake means located at an end of said housing opposite to said water intake means, said air intake means leading to mixing means located within said housing wherein pressurized water from said water pump is mixed with air from said air intake means to form a stream of pressurized water admixed with bubbles said air intake means having an external tubular extension of variable length whereby the apparatus may be submerged and the most distal aspect of the air intake means may be above water level;

(e) output means positioned on said housing intermediate said water intake means and said air intake means;

(f) filtration means for preventing foreign objects from entering said water pump;

(g) a plurality of suction cups provided on a surface of said housing, wherein said surface forms approximately a 90° angle with said end of said housing wherein said water intake is located, so that said bubble bath apparatus can be detachably attached to a wall of a bathtub said plurality of suction cups including at least one suction cup having a ball-and-socket mounting means on said housing whereby the suction cup may be pivoted, thereby allowing the apparatus to be attached to a non-planer surface; and (h) at least one handle mounted on the housing for manipulation of the apparatus during hand held use.

2. A hand-held bubble bath apparatus according to claim 1, in which said external tubular extension to said air intake means is made of flexible material.

3. A hand-held bubble bath apparatus according to claims 1, or 2, in which an air intake head is included on the most distal portion of said external tubular extension to said air intake means, said air intake head including a plurality of intake ports of a diameter less than the diameter of said external tubular extension, whereby a negative pressure is generated within said air intake head thereby reducing noise output.

4. A hand-held bubble bath apparatus according to claim 1, wherein the output means comprises a jet nozzle pivotally connected to the housing through universal coupling means.

* * * * *